US007238054B2

(12) United States Patent
Higeta et al.

(10) Patent No.: US 7,238,054 B2
(45) Date of Patent: Jul. 3, 2007

(54) ELECTRICAL CONNECTOR

(75) Inventors: Takuya Higeta, Koto-ku (JP); Kazuyuki Ozai, Koto-ku (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 11/356,660

(22) Filed: Feb. 17, 2006

(65) Prior Publication Data

US 2006/0189182 A1 Aug. 24, 2006

(30) Foreign Application Priority Data

Feb. 18, 2005 (JP) ..... 2005-041899

(51) Int. Cl.
*H01R 24/00* (2006.01)

(52) U.S. Cl. ..... 439/637

(58) Field of Classification Search ..... 439/637, 439/630, 79

See application file for complete search history.

(56) References Cited

U.S. PATENT DOCUMENTS 3,172,718 A * 3/1965 Lalonde ..... 439/634
3,348,191 A * 10/1967 Kinkaid ..... 439/637
4,077,694 A * 3/1978 Cobaugh et al. ..... 439/633
5,041,023 A * 8/1991 Lytle ..... 439/637
RE35,508 E * 5/1997 Lemke et al. ..... 439/101
6,840,809 B2 * 1/2005 Wu ..... 439/637
6,942,524 B2 * 9/2005 Wu ..... 439/637

* cited by examiner

*Primary Examiner*—Tulsidas C. Patel
*Assistant Examiner*—Phuongchi Nguyen
(74) *Attorney, Agent, or Firm*—Baker Botts LLP

(57) ABSTRACT

A connector includes a plurality of contacts each having at one end a contact portion adapted to contact a connecting object, at the other end a connection portion to be connected to a substrate or the like, and between the contact and connection portions a fixed portion to be arranged and held in a housing so that the contact portion is displaceable about the fixed portion as a fulcrum in a cantilevered manner relative to the housing arranging and holding the contacts. If the thickness of the housing where the contact portions of the contacts are displaceable is not more than 0.6 to 0.7 mm, the housing is provided with a protrusion formed with a hole to permit the contact portions to be displaceable in the hole, thereby ensuring sufficient contact pressures to obtain stable connection with a mating connector without unintended deformations of the contacts.

4 Claims, 2 Drawing Sheets

ELECTRICAL CONNECTOR

CROSS-REFERENCE TO RELATED APPLICATIONS

This application claims priority from Japanese Patent Application No. 2005-041,899, filed Feb. 18, 2005, which is herein incorporated by reference in its entirety.

BACKGROUND OF THE INVENTION

This invention relates to a connector for use in various kinds of electronic and electric equipment and devices of hard disk drives (HDD), servers and personal computers, and more particularly to a connector capable of preventing unintended deformation of contacts when connecting a mating connector.

Such connectors serve to connect various kinds of electronic and electric equipment and devices of hard disk drivers (HDD), servers and personal computers to exchange mutually signals between the electronic and electric equipment and devices. For this purpose, the connector is mounted on a substrate, panel or the like so as to be connected to a mating connector.

In order to achieve such a purpose, generally the connector at least comprises contacts adapted to contact the mating connector, and a housing for holding the contacts. For fitting with the mating connector, the connector includes a fitting portion whose size may be determined by dimensional relation to the mating connector and S-ATA and SAS standards. According to the S-ATA and SAS standards, the thickness of the fitting portion of the housing is determined as 0.6 to 0.7 mm.

The contacts each include a contact portion at one end adapted to contact a connecting object, a connection portion at the other end to be connected to a substrate or the like, and between the contact portion and the connection portion a fixed portion to be arranged and held in the housing. The contact portion is held in the housing to be displaceable relative to the fixed portion as a fulcrum in a cantilevered manner. These are typical constructions of the connectors, for which prior art patent literatures will not be cited here.

Recently, there has been a strong need for miniaturization of connectors. In the case that contacts are supported in the cantilevered manner as described above and a thickness of the fitting portion of the housing is only 0.6 to 0.7 mm, it would be impossible to ensure sufficient contact pressures because sufficient displacement of contact portions of the contacts cannot be achieved within such a small thickness of the fitting portion, and further the contacts would tend to be collapsed or deformed to an excessive extent, resulting in a defective or failed connection.

Moreover, if the displacement of the contacts is restrained in a manner to avoid their excessive deformation, no sufficient contact pressure can be obtained, thereby causing a defective connection.

SUMMARY OF THE INVENTION

It is an object of the invention to provide a connector which eliminates all the disadvantages of the prior art as described above and which is able to ensure sufficient contact pressures to obtain stable connection with a mating connector without any unintended deformation or collapse of the contacts.

Such an object can be achieved by the connector 10 according to the invention including a plurality of contacts

14 each having at one end a contact portion 36 adapted to contact a connecting object, at the other end a connection portion 38 to be connected to a substrate or the like, and between the contact portion 36 and the connection portion 38 a fixed portion 40 to be arranged and held in the housing 12 so that the contact portion 36 is displaceable relative to the fixed portion 40 as a fulcrum in a cantilevered manner, and the housing 12 arranging and holding the contacts 14, wherein in the case that a thickness of the housing 12 where the contact portions 36 of the contacts 14 are displaceable is not more than 0.6 to 0.7 mm, the housing 12 is provided with a protrusion 20, and the protrusion 20 is formed with a hole 22 to permit the contact portions 36 to be displaceable in the hole 22.

In a preferred embodiment, the hole 22 is formed as individual holes for the contacts 14. Moreover, when a contact pressure of the contacts 14 is 20 to 70 gf (gram-force), the protrusion 20 is formed to a thickness of 0.3 to 0.7 mm. If the thickness of the protrusion 20 is not more than 0.3 mm, a contact pressure of 20 to 70 gf cannot be obtained, while the thickness of the protrusion of not less than 0.7 mm does not achieve the miniaturization of the connector 10 and is out of the S-ATA and SAS standards.

As can be seen from the above description, the connector 10 according to the invention can bring about the following significant effects.

(1) According to the invention, the connector 10 includes a plurality of contacts 14 each having at one end a contact portion 36 adapted to contact a connecting object, at the other end a connection portion 38 to be connected to a substrate or the like, and between the contact portion 36 and the connection portion 38 a fixed portion 40 to be arranged and held in the housing 12 so that the contact portion 36 is displaceable relative to the fixed portion 40 as a fulcrum in a cantilevered manner, and the housing 12 arranging and holding the contacts 14, wherein in the case that a thickness of the housing 12 where the contact portions 36 of the contacts 14 are displaceable is not more than 0.6 to 0.7 mm, the housing 12 is provided with a protrusion 20, and the protrusion 20 is formed with a hole 22 to permit the contact portions 36 to be displaceable in the hole 22. Therefore, sufficient contact pressures of the contacts 14 can be achieved without any collapse or unintended excessive deformation of the contacts and without causing any defective or failed connection.

(2) The hole 22 is formed as individual holes for the contacts 14. Therefore, sufficient displacements and contact pressures of the contact portions of the contacts are obtained, while maintaining the required strength of the housing 12.

(3) In the case that a contact pressure of the contacts 14 is 20 to 70 gf, the protrusion 20 is formed to a thickness of 0.3 to 0.7 mm. Accordingly, sufficient contact pressures can be ensured without any unintended excess deformation or collapse of the contacts so that no failed connection occurs and the miniaturization of the connector is not adversely affected.

The invention will be more fully understood by referring to the following detailed specification and claims taken in connection with the appended drawings.

DESCRIPTION OF THE PREFERRED EMBODIMENTS

Figure 1A:
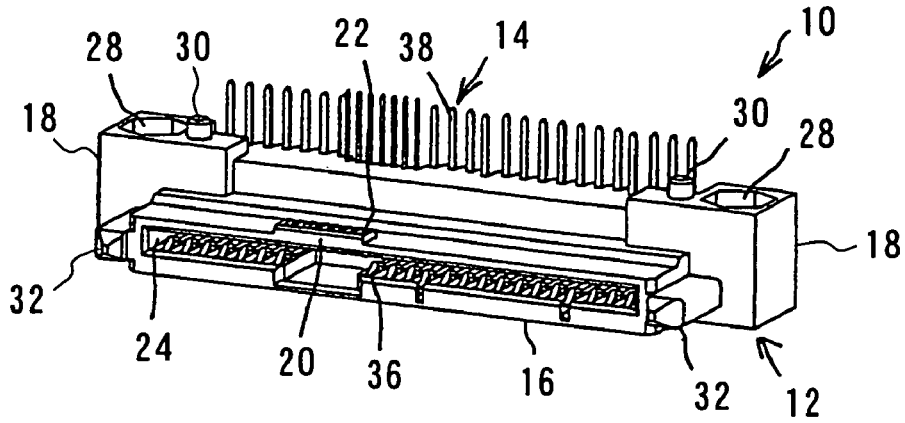
FIG. 1A is a perspective view of the connector according to the invention viewed from the below on the side of the fitting portion.
Figure 1B:
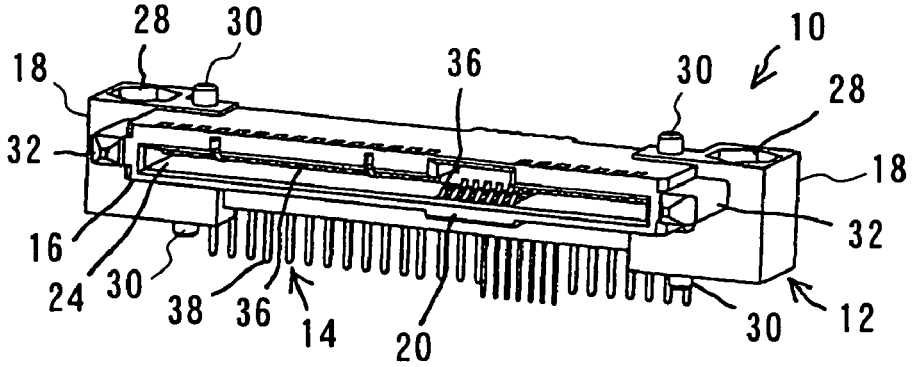
FIG. 1B is a perspective view of the connector according to the invention viewed from the above on the side of the fitting portion.
Figure 1C:
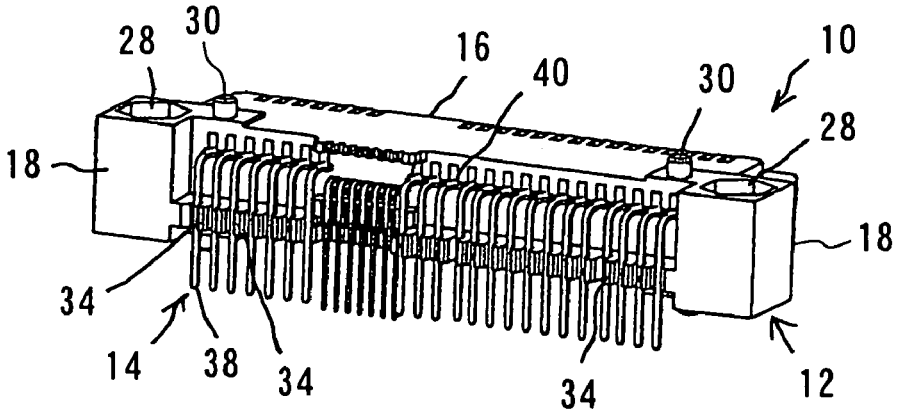
FIG. 1C is a perspective view of the connector according to the invention viewed from the above on the side of the connection portions of the contacts.
Figure 2A:
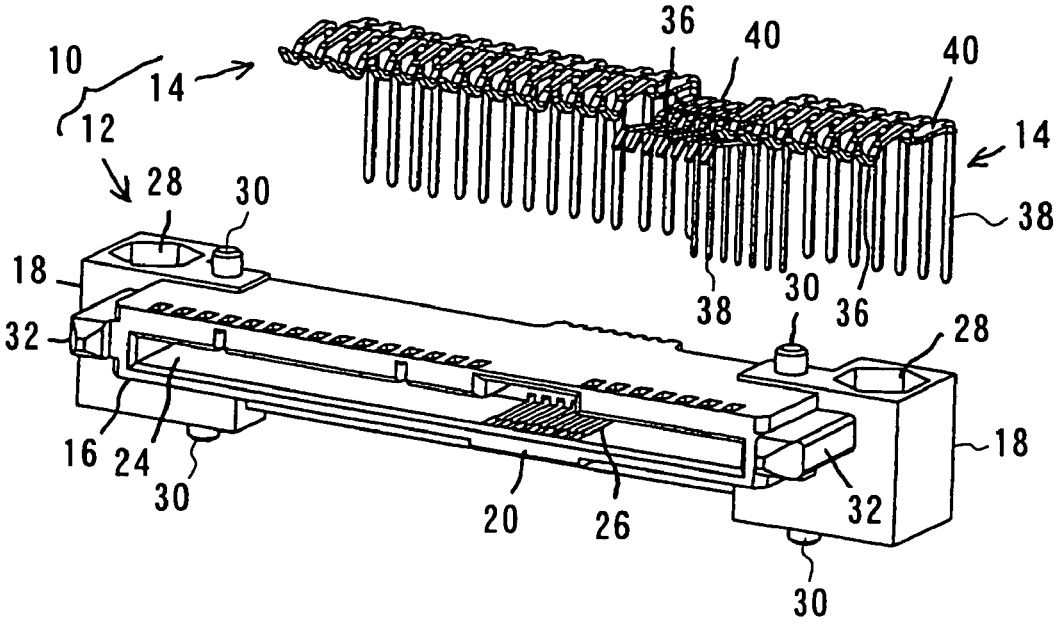
FIG. 2A is an exploded perspective view of the connector according to the invention with the housing and contacts separated, viewed from the above on the side of the fitting portion.
Figure 2B:
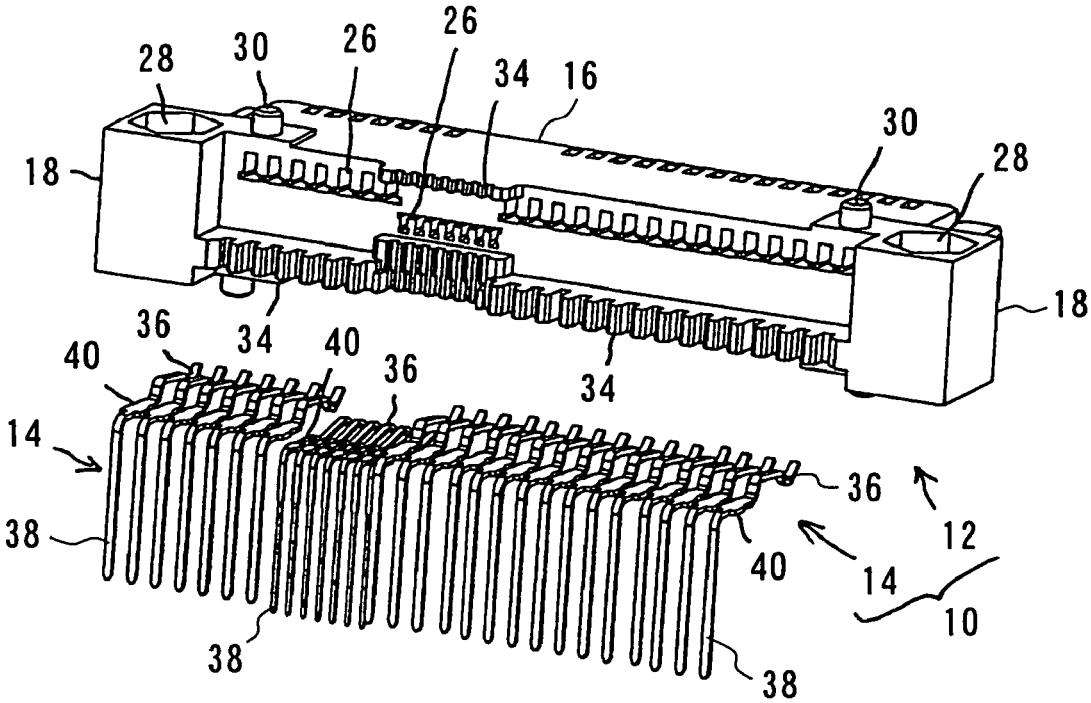
FIG. 2B is an exploded perspective view of the connector according to the invention with the housing and contacts separated, viewed from the above on the side of the connection portions of the contacts.

One embodiment of the connector 10 according to the invention will be explained with reference to FIGS. 1A to 2B. FIG. 1A is a perspective view of the connector according to the invention viewed from the below on the fitting side, while FIG. 1B is a perspective view of the connector shown in FIG. 1A viewed from the above on the fitting side. FIG. 1C is a perspective view of the connector shown in FIG. 1A viewed from the above on the side of connection portions of contacts. FIG. 2A is an exploded perspective view of the connector with the housing and contacts separated, viewed from the above on the fitting side, while FIG. 2B is an exploded perspective view of the housing and contacts of FIG. 2A viewed from the above on the side of the connection portions of the contacts.

The connector 10 according to the one embodiment of the invention at least comprises a housing 12 and contacts 14.

First, the housing 12 will be explained, which is one subject matter of the invention. The housing 12 is formed from an electrically insulating plastic material by means of the injection molding of the known technique. The materials suitable for the housing 12 include polybutylene terephthalate (PBT), polyamide (66 PA or 46 PA), liquid crystal polymer (LCP), polycarbonate (PC) and the like and combination thereof in consideration of dimensional stability, workability, manufacturing cost and the like. The housing 12 comprises a fitting portion 16 for fitting with a mating connector, and the fitting portion 16 is formed with a fitting opening 24 into which the mating connector is inserted. Sizes of the fitting portion 16 and the fitting opening 24 may be designed so as to be able to fit with the mating connector.

In the case that the thickness of the fitting portion 16 of the housing 12 is only 0.6 mm to 0.7 mm, the housing 12 is provided with a protrusion 20 as shown in FIG. 1A. The protrusion 20 is formed with holes 22 in which contact portions 36 of the contacts 14 are displaceable. The holes 22 may be one hole common to the contacts 14 to be arranged in the hole or may be individual holes for the contacts. The individual holes are preferable in consideration of the strength of the housing 12 and a risk of contact between the contacts 14 to each other to cause failed connection.

The size of the protrusion 20 may be suitably designed in accordance with required contact pressures of the contacts 14. In an actual case, the thickness of the protrusion is 0.3 mm to 0.7 mm when the contact pressure of the contacts 14 is 20 to 70 gf (gram-force). If the contact pressure of 20 gf is required, the displacement of the contacts 14 of 0.2 to 0.4 mm is needed so that the thickness of the protrusion 20 is determined to be 0.3 mm. When the contact pressure of the contacts 14 of 70 gf is required, the displacement of the contacts of 0.7 to 0.9 mm is needed so that the thickness of the protrusion 20 is determined to be 0.7 mm. In view of the miniaturization of the connector and the stable connection, it is most preferable that the contact pressure is 30 to 50 gf and the thickness of the protrusion is 0.4 to 0.5 mm.

The housing 12 is formed with inserting holes 26 for receiving the contacts 14. The size of the inserting holes 26 may be suitably designed such that the contacts 14 can be press-fitted in the inserting holes and held thereat.

The housing 12 is further provided with flanges 18 at longitudinal ends for mounting the connector onto a substrate, and the flanges are each provided with pins 30 for positioning the housing 12 relative to the substrate and with a nut receiving hole 28 for fixing the connector 10 to the substrate. Sizes and positions of the pins 30 and the nut receiving holes 28 may be suitably designed in consideration of purpose to be used, miniaturization of the connector and the like. The pins 30 are provided on both the sides of the thickness of the housing 12 or above and below of the housing in the illustrated embodiment for accommodating a case that the connection portions 38 of the contacts 14 are bent downward, in addition to the case bending upward as shown in FIG. 1A.

The housing 12 is further provided with positioning bosses 32 at both the longitudinal ends for positioning a mating connector and preventing an erroneous insertion of the mating connector. The size of the positioning bosses 32 may be suitably designed in consideration of their functions of positioning and prevention of erroneous insertion of the mating connector, the miniaturization of the connector 10, the strength of the housing 12 and the like.

The housing 12 is further provided on the opposite side of the fitting opening 24 with comb-shaped projections 34 for positioning the connection portions 38 of the contacts 14 between the projections. The size of the comb-shaped projections 34 may be suitably designed in consideration of their functions, widths of the contacts, insertion of the connection portions into the substrate and the like.

Finally, the contacts 14 will be explained. The contacts 14 are made of a metal and formed by means of the press-working of the known technique. Preferred metals from which to form the contacts 14 include brass, beryllium copper, phosphor bronze and the like which comply with the requirements such as springiness, workability, electric conductivity and the like.

The contacts 14 each mainly comprise a contact portion 36 adapted to contact a mating object, a fixed portion 40 to be fixed to the housing 12, and a connection portion 38 to be connected to a substrate or the like. The contact portions 36 adapted to contact the mating object are suitably designed so as to extend into the fitting opening 24 so that they are brought into contact with the mating object.

The fixed portions 40 of the contacts 14 may be designed so as to be fixed to the housing 12 by means of press-fitting, lancing (hooking), welding or the like, and are fixed to the housing by the press-fitting in the illustrated embodiment. The connection portions 38 of the contacts 14 may be suitably designed in either of surface mounting type (SMT) and dip type according to a specification of the substrate. In the illustrated embodiment, the dip type is employed. The contacts 14 are supported in the housing in a cantilevered manner so that the contact portions 36 are displaceable relative to the fixed portions 40 as fulcrums.

Examples of applications of the present invention are connectors 10 for use in various kinds of electronic and electric equipment and devices of hard disk drives, servers and personal computers, and particularly connectors of capable of preventing contacts from being inadvertently deformed or collapsed when connecting to a mating connector.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A connector including a plurality of contacts, each contact having a contact portion at one end adapted to contact a connecting object, a connection portion at the other end to be connected to a substrate, and a fixed portion to be arranged between said contact portion and said connection portion and held in a housing so that said contact portion is displaceable relative to said fixed portion as a fulcrum in a cantilevered manner, wherein said housing arranges and holds said contacts, the housing thickness is not more than 0.6 to 0.7 mm in the area where said contact portions of the contacts are displaceable, said housing is provided with a protrusion toward the outside of the housing, and said protrusion is formed with a hole inside said protrusion to permit said contact portions to be displaceable in said hole.

2. The connector as set forth in claim 1, wherein when a contact pressure of said contacts is 20 to 70 gf, said protrusion is formed to a thickness of 0.3 to 0.7 mm.

3. The connector as set forth in claim 1, wherein said hole is formed as individual holes for said contacts.

4. The connector as set forth in claim 3, wherein when a contact pressure of said contacts is 20 to 70 gf, said protrusion is formed to a thickness of 0.3 to 0.7 mm.

* * * * *